US005740652A

United States Patent [19]

Inoue et al.

[11] Patent Number: 5,740,652

[45] Date of Patent: Apr. 21, 1998

[54] METHOD OF INSTALLING SEISMIC DAMPING WALL

[75] Inventors: Katsufumi Inoue, Fujieda; Mitsuo Miyazaki; Masami Nomori, both of Tokyo; Fumiaki Arima, Oyama, all of Japan

[73] Assignee: Sumitomo Construction Co., Ltd., Tokyo, Japan

[21] Appl. No.: 664,151

[22] Filed: Jun. 13, 1996

[51] Int. Cl.[6] ..... E04B 1/98

[52] U.S. Cl. ..... 52/745.1; 52/167.1; 52/167.8; 52/745.09

[58] Field of Search ..... 52/167.1, 167.8, 52/741.1, 745.1, 745.2, 745.09

[56] References Cited

U.S. PATENT DOCUMENTS

| | | | |
|---|---|---|---|
| 4,731,966 | 3/1988 | Fujita et al. . | |
| 4,873,798 | 10/1989 | Sato . | |
| 4,959,934 | 10/1990 | Yamada et al. . | |
| 5,072,569 | 12/1991 | Van Tassel | 52/745.1 |
| 5,074,095 | 12/1991 | Wilnau | 52/745.2 |
| 5,134,818 | 8/1992 | Van Parera . | |
| 5,177,918 | 1/1993 | Chang . | |
| 5,236,115 | 8/1993 | Pape . | |
| 5,462,141 | 10/1995 | Taylor . | |

FOREIGN PATENT DOCUMENTS

| | | | |
|---|---|---|---|
| 0 477 144 A1 | 8/1991 | European Pat. Off. . | |
| 2047477 | 2/1990 | Japan | 52/167.8 |
| 3025173 | 2/1991 | Japan | 52/167.8 |
| 1-673-453 | 6/1992 | Japan . | |

*Primary Examiner*—Christopher T. Kent
*Attorney, Agent, or Firm*—Coudert Brothers

[57] ABSTRACT

A method of installing a seismic damping wall where the seismic damping wall is attached to the upper floor beam prior to installing the upper floor beam. A hanging plate is placed in the chamber defined by a standing structure plate. The hanging plate is temporarily attached to the standing structure plate. The top edge of the hanging plate is affixed to a horizontal structural beam that upon installation in the building will be an upper floor structural beam. The combined unit, comprising the horizontal structural beam, the hanging plate and the standing plate structure, is placed in position and the horizontal structural beam on the upper floor is installed in the building structure. The chamber is filled with a viscous liquid. The hanging plate and the standing plate structure which were temporarily fastened together are separated from each other. The standing plate structure is lowered down toward the horizontal structural beam on the lower floor. The bottom edge of the standing plate structure is fixed to the horizontal structural beam on the lower floor.

6 Claims, 7 Drawing Sheets

METHOD OF INSTALLING SEISMIC DAMPING WALL

FIELD OF THE INVENTION

This invention relates to the field of seismic construction techniques and is specifically directed to a method of installing seismic damping walls which use the viscous resistance of a fluid to dampen and reduce building vibration in the event of seismic activity.

BACKGROUND OF THE INVENTION

During earthquakes, multi-story medium to large high-rise buildings are seriously affected by horizontal shear force due to relative deformation. As is well known, severe earthquakes, when the horizontal shear force is large, cause major destruction, destroying columns which support the different stories of the structures with catastrophic results. Damage may be particularly severe when the natural period of the building is close to the period of ground motion caused by the earthquake, causing resonance which amplifies the vibration.

Several construction techniques have been developed in order to prevent the destruction of buildings from earthquakes. One of them is the use of a seismic damping wall as described in the co-assigned Japanese Patent No. 1-673453. The seismic damping wall described in the patent enhances damping performance in multi-story structures. A seismic damping wall 101 of this type (shown in FIG. 7) has a hanging plate 102 fixed to the upper floor and a standing plate structure 103, which forms a chamber made of two plates. The chamber is filled with a viscous liquid 104 into which the hanging plate 102 is inserted such that the hanging plate 102 is disposed between the two plates of the standing plate 103. During an earthquake, relative movement occurs between the hanging plate attached to the upper floor and the standing plate attached to the lower floor. The viscous fluid between these plates develops a resistance in proportion to the relative velocity between the upper floor and the lower floor. This resistance develops a viscous resistance force which reduces the relative movement between the hanging and standing plates. In effect, the viscous fluid absorbs some of the energy of the earthquake and prevents damage to the structure.

Heretofore, the method of installing such a seismic damping wall was as follows: The hanging plate 102 and the standing plate 103 were pre-manufactured in the factory. These two plates are joined together by inserting the hanging plate 102 into the chamber of the standing plate 103. Viscous fluid 104 was then added to fill the space between the two plates of the standing plates. These pre-fabricated plates were then carried to the job site and placed in an upright position near the place of planned installation of seismic damping wall 101. The horizontal structural beam for the lower floor and the horizontal structural beam for the upper floor, to which the above-mentioned plates were to be fixed, would have already been installed and firmly fixed to the building, where they function as structural elements.

Wall 101, as indicated in FIG. 8(*b*), would then be carried and moved horizontally (perpendicular to the hanging plate and standing plate), and be installed to the building structure supported by tools such as jacks (not shown). After the standing plate 103 is joined to the horizontal structural beam on lower floor 105, hanging plate 102 and standing plate 103 which were temporarily fastened are separated. As shown in FIG. 9, hanging plate 102 is lifted by a jack (not shown) and is joined to the horizontal structural panel 106, e.g., a steel beam, on the upper floor and fastened by bolts.

The above-mentioned installation method requires a great deal of time and labor. Since wall 101 encompasses a large area and consists of very heavy steel plates, its installation requires use of a crane chain block. It also requires carrying the device in a horizontal direction with rollers and trucks. During storage or transportation, the preassembled wall structure needs to be kept in a stable upright position.

Furthermore, installation of the wall members may increase the amount of time necessary for construction, since the installation needs to be done between the plane of the columns and beams.

SUMMARY OF THE INVENTION

We have developed a new installation method for a seismic wall taking into consideration the problems stated above. Its goal is to achieve the efficient installation of a seismic damping wall between the upper and lower floors of a multi-story building. The method of the present invention is applied to the type of seismic damping wall which uses a viscous fluid injected into the space between a hanging plate and a standing plate and having the following structure: the top edge of the hanging plate is joined to the horizontal structural beam for the upper floor, the bottom edge of the standing plate into whose chamber the hanging plate has been installed is fastened to the horizontal structural beam on the lower floor where the lower horizontal structural beam is fixed prior to the installation of the seismic wall.

The hanging plate and standing plate are temporarily fastened together in the following manner: The distance between the top edge of the hanging plate and the bottom edge of the standing plate should be shorter than the required distance between the surface of the upper floor horizonal structural beam and the surface of the lower floor horizontal structural beam. The top edge of the hanging plate is affixed to the horizontal structural beam on the upper floor before the structural beam is installed in the building structure. The combined unit consisting of the horizontal structural beam, hanging plate and the standing plate is lifted up by crane, and the horizontal structural beam on the upper floor is installed in the building structure. The hanging plate and the standing plate which were temporarily fastened together are then separated. The standing plate is lowered down toward the horizontal structural beam on the lower floor. The bottom edge of the standing plate is fixed to the horizontal structural beam on the lower floor.

In one embodiment of the present invention, the viscous fluid is filled between the hanging plate and standing plate before separating these two plates which were temporarily fastened together.

The above-mentioned hanging plates can consist of one plate or more than two plates in parallel with some distance in between.

It is necessary that the standing plate structure completely enclose the hanging plate, forming a chamber-like structure. When there are a plurality of hanging plates, each hanging plate is disposed in a separate chamber defined by two plates of the standing plate structure such that there is only one hanging plate in one chamber.

The horizontal structural beams of both the upper and lower floors can be installed either to beams or to floors. However, they are preferably installed to beams. The horizontal beams can be steel or concrete. When using concrete, it is preferred that pre-cast concrete cast in a factory or manufacturing yard be used. Preferably, cast-in place concrete is not used.

The method of combining a hanging plate and a standing plate can be planned. However, even though the hanging and standing plates should be combined firmly, they should easily separate from each other when they are released.

The viscous fluid can be filled either before temporarily fastening the hanging plate and the standing plate, or immediately after mechanically attaching these plates. It can also be filled after the horizontal components of the upper floor which form the combined unit (horizontal beam, hanging plate, and standing plate structure) are installed on the building structure.

According to the present invention, the horizontal structural beam of the lower floor is first installed in the building structure. The unit which was temporarily combined with the hanging plate and standing plate is fixed to the horizontal structural member of the upper floor.

Therefore, as the method of the present invention enables the installation of the device together with the installation of columns and beams, it saves the time and effort that the prior art method required for carrying the damping device and transporting it horizontally.

Preferably, the hanging plate and standing plate structure are temporarily fastened together after the distance between the top edge of the hanging plate and the bottom edge of the standing plate has been adjusted, such that the adjusted distance is shorter than the distance between the upper and lower floors. Therefore, the device does not touch the lower floor level when the upper floor horizontal structural beam is installed in the building structure. This helps avoid the trouble of determining the exact sizing and positioning of the seismic wall prior to installation.

Furthermore, as the standing plate descends slowly toward the horizontal structural beam on the lower floor, it permits installing the standing plate more precisely.

In one embodiment of the method of the present invention, the viscous fluid is filled between the hanging plate and the standing plate before separating these plates which were temporarily combined. Therefore, the standing plate can be slowly let down utilizing the resistance of the viscous fluid after the separation of the combined unit.

BRIEF DESCRIPTION OF THE DRAWINGS

FIG. 1(*b*) is a cross sectional view along line 1—1 of FIG. 1(*a*) illustrating the installation of the seismic damping wall.

DETAILED DESCRIPTION OF THE DRAWINGS

Figure 1A:
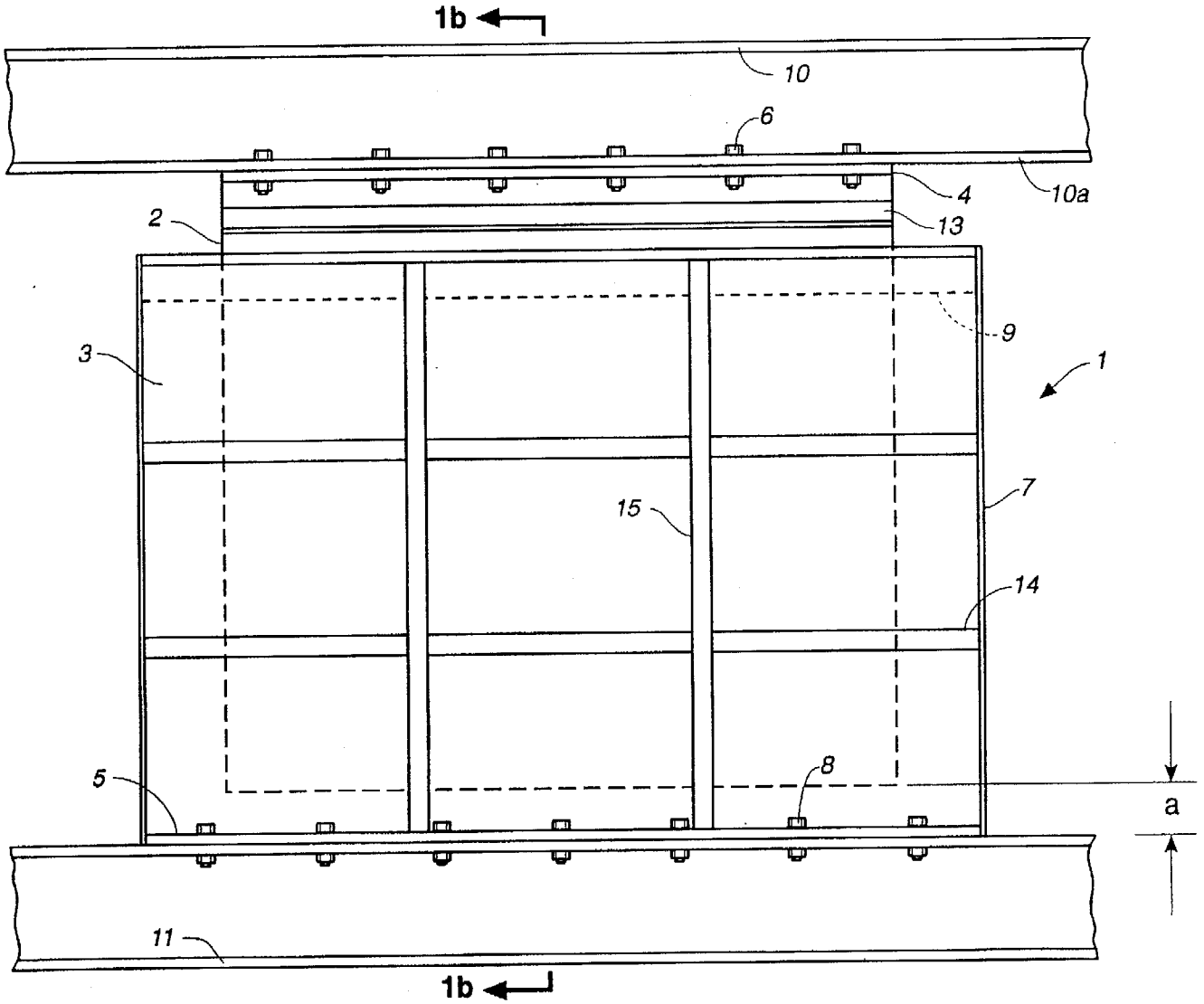
FIG. 1(*a*) is a side view which illustrates the installation of the seismic damping wall.
Figure 1B:
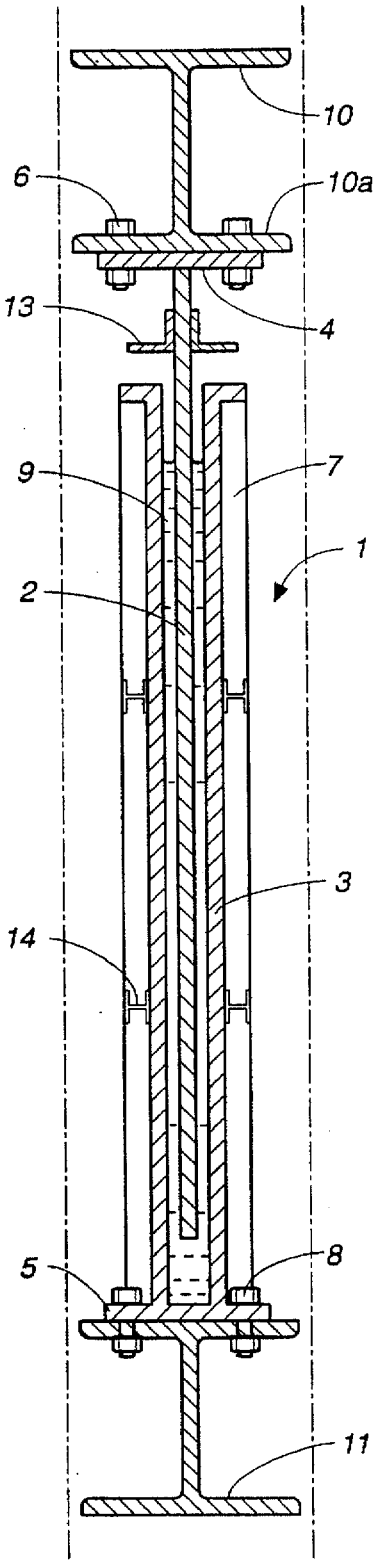
Figure 4B:
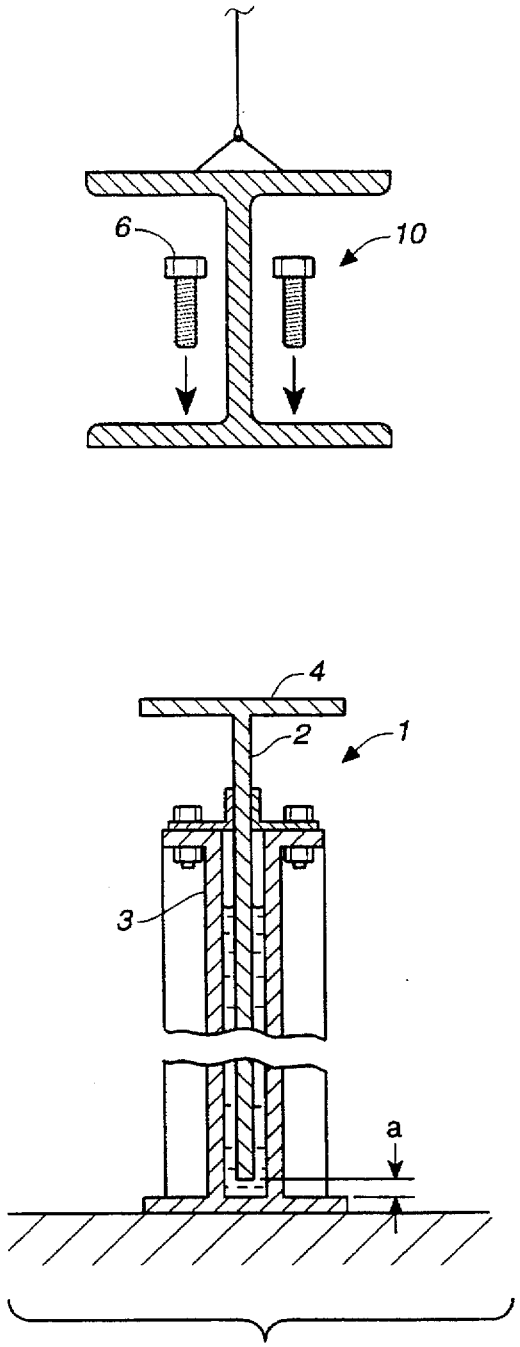
FIGS. 4(*a*), (*b*) & (*c*) are an example of an installation of the seismic damping wall.

FIG. 1(*a*) is a side view which illustrates an example of the seismic damping wall installed in the method pertaining to this invention. FIG. 1(*b*) is its cross sectional view along line 1—1 of FIG. 1(*a*).

The seismic damping wall 1 has one hanging plate 2, the top edge of which is affixed to the steel beam of the upper floor 10, and a standing plate structure comprising two separate parallel standing plates. These standing plates are on both sides of the hanging plate. Thus, the hanging plate is disposed in the chamber defined by the two separate parallel standing plates.

The hanging plate 2 is affixed to the steel beam 10 through installation plate 4. The hanging plate 2 and the installation plate 4 are connected with welding. The installation plate 4 is connected to the bottom flange 10*a* of the steel beam with bolts 6.

The hanging plate 2 is designed to have a clearance, a, in between the bottom edge of hanging plate 2 and the lower installation plate 5. This clearance a is specified so that the hanging plate 2 does not reach installation plate 5 or standing plate 3 even when relative deformation develops during an earthquake. In this example, steel of 9 mm thickness is used for the hanging plate, but the thickness can be varied in accordance with the scale and vibration characteristics of the building.

The horizontal length of standing plate 3 is longer than the hanging plate 2 by more than the length of relative deformation on both sides. Both side edges of standing plate structure 3 are connected to edge plate 7, thus forming a container. The bottom edge is connected to the installation plate 5 with welding. The installation plate 5 is connected to the steel beam 11 on the lower floor with bolts 8 at the job site. In this example, steel of 19 mm thickness is used for the standing plate 3 and the gap between the hanging plate is approximately 10 mm. However, these dimensions can be altered according to the conditions in the particular case.

Viscous fluid 9 is placed in the chamber formed by the two parallel plates of standing plate structure 3. The viscous fluid fills the area between the hanging plate 2 and the standing plate 3. Items 14 and 15 are reinforcement material to prevent the deformation of the standing plate 3.

Figure 2:
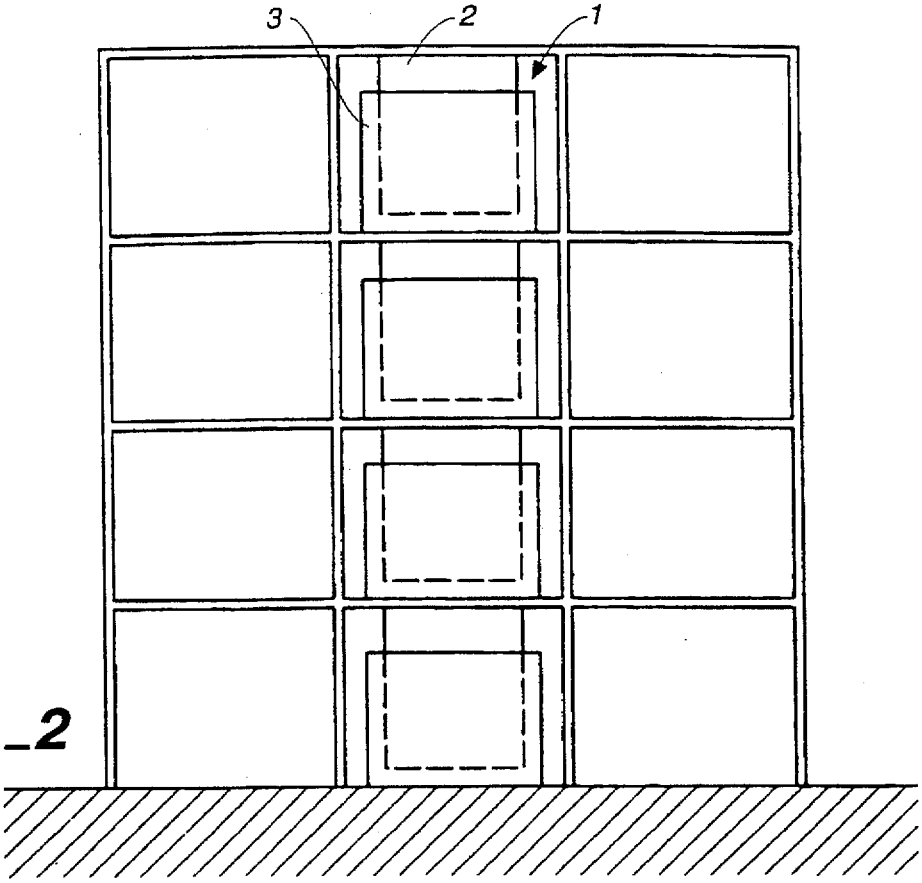
FIG. 2 is an illustration showing the frame structure of a multi-layered structure with the seismic damping wall.
Figure 3:
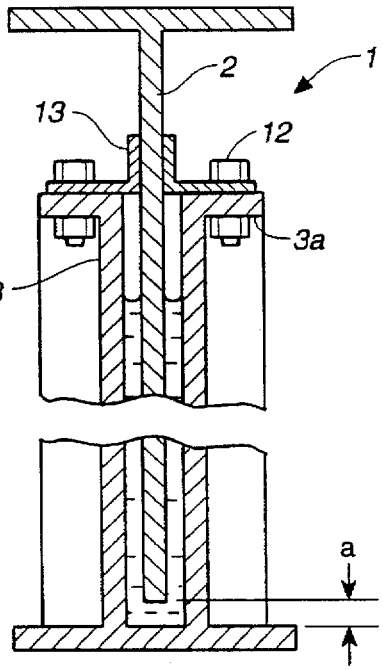
FIG. 3 is an example of an installation of the seismic damping wall.
Figure 4A:
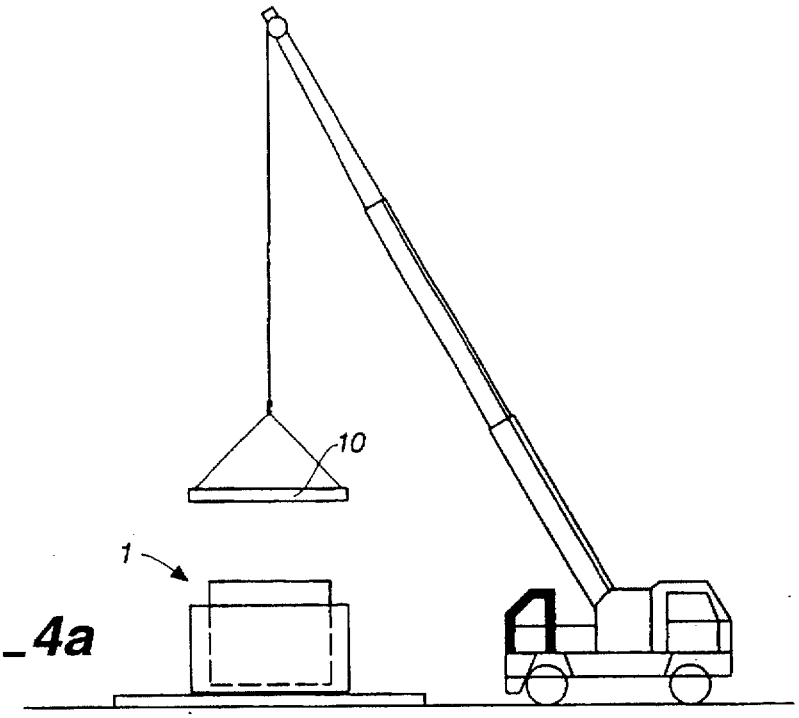

The seismic damping wall, as illustrated in FIG. 2, is installed on each floor in a multi-story rahmen structured building. It is attached to beams between the upper floor and the lower floor. When the building is subjected to horizontal vibration during an earthquake, a relative displacement develops between the hanging plate 2 and the standing plate 3. With this relative deformation, the viscous fluid 9 creates a resistance through shear displacement. This viscous resistance acts as a damper against vibration.

The above-mentioned seismic damping wall is installed in the following way: the seismic damping wall 1 is prefabricated in the factory. The hanging plate 2 and standing plate 3 are temporarily combined so that the lower clearance a is shorter than the actual length needed to reach the structure. The shaped steel 13, attached to the top portion of the hanging plate, is connected to the flange 3*a*, installed along the standing plate 3 with a bolt 12. The seismic damping wall is transported to the job site and is affixed to the steel beam 10. These are fastened in the following way: Steel beam 10 is slowly set down on the temporarily placed damping wall until it reaches the top surface of the installation plate 4 on hanging plate 2 and these are joined with a bolt 6.

Figure 5:
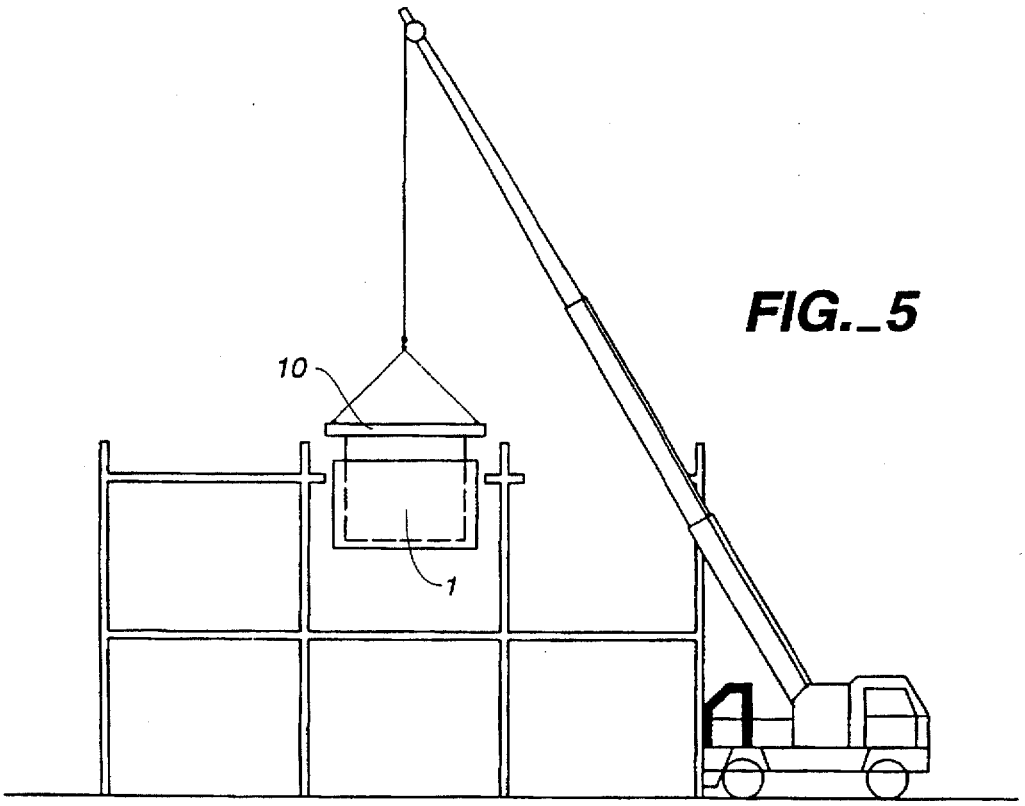
FIG. 5 is an example of an installation of the seismic damping wall.
Figure 6A:
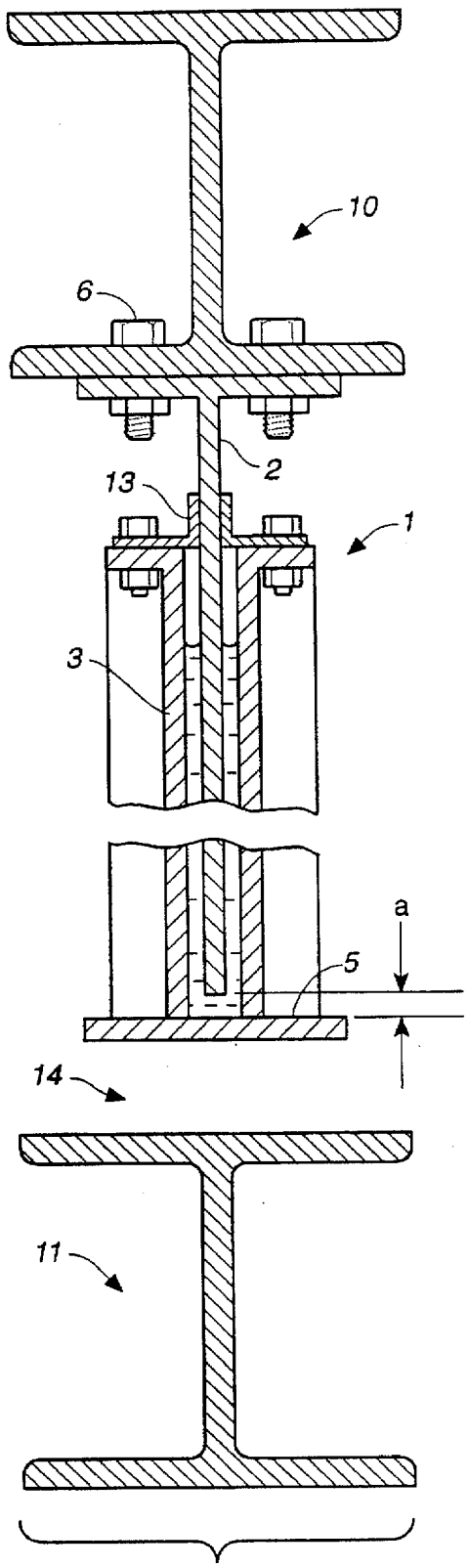
FIGS. 6(*a*) & (*b*) are also an example of an installation of the seismic damping wall.
Figure 6B:
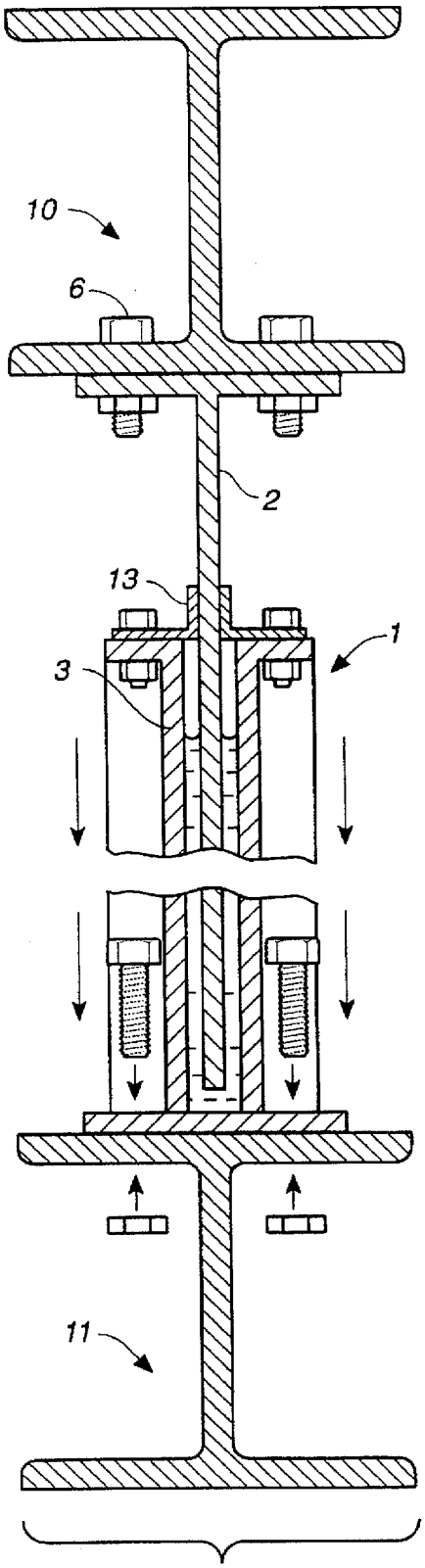
Figure 7B:
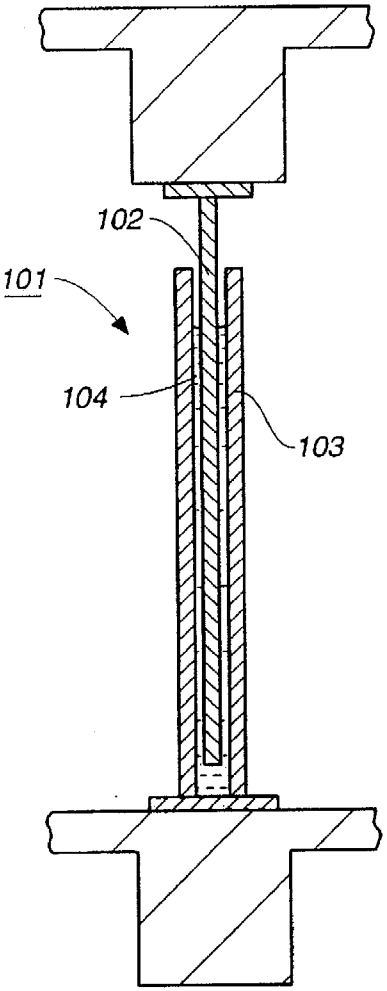
FIG. 7b (PRIOR ART)
FIGS. 7(*a*) & (*b*) show the structure of the seismic damping wall according to the prior art.
Figure 7A:
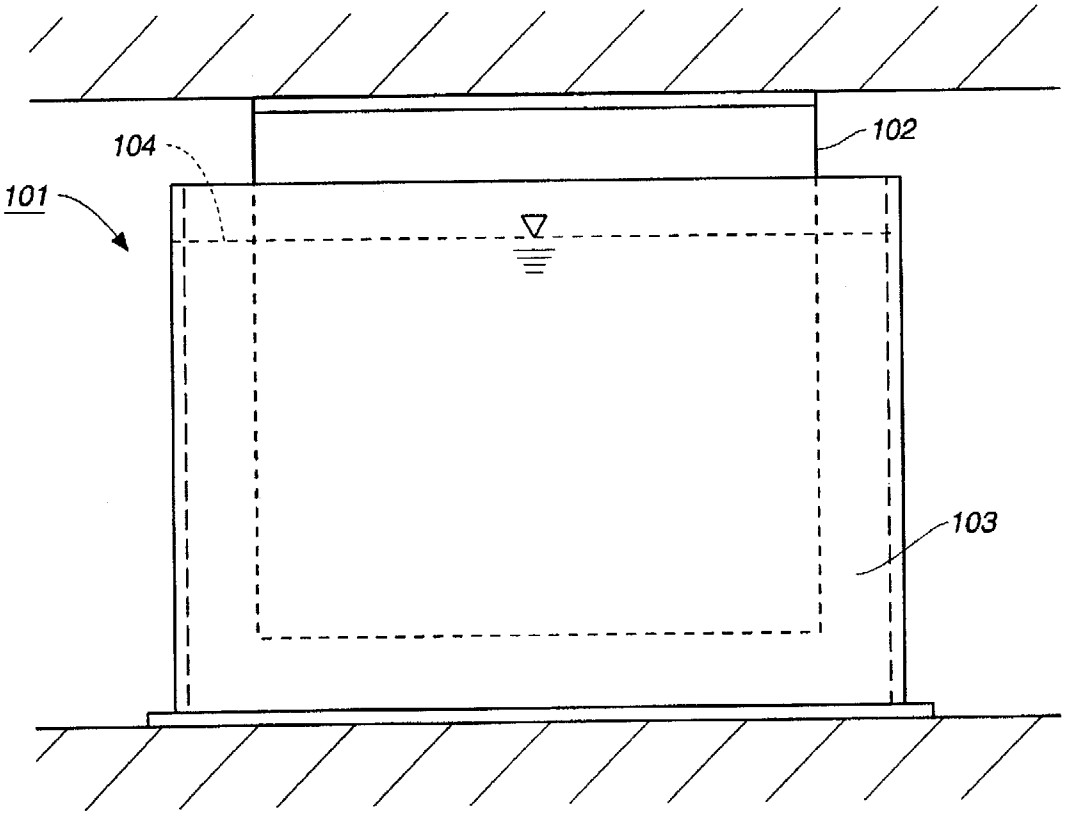
FIG. 7a (PRIOR ART)
Figure 9:
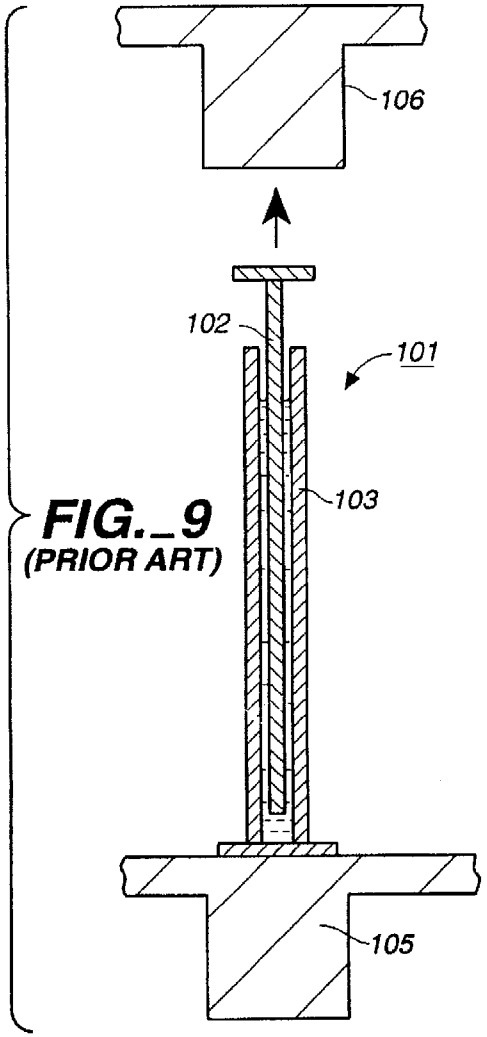
FIG. 9 (PRIOR ART)
FIG. 9 shows the usual installation of the seismic damping wall according to the prior art.
Figure 8B:
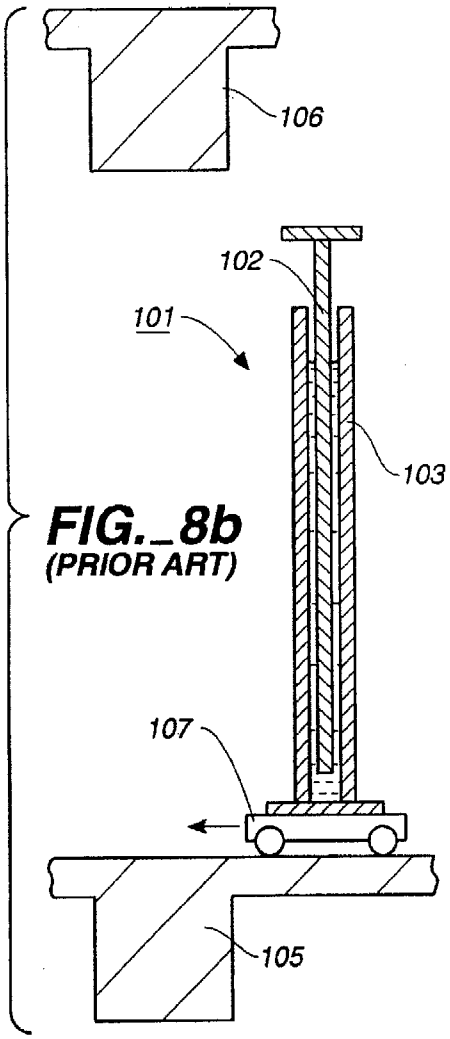
FIG. 8b (PRIOR ART)
FIGS. 8(*a*) & (*b*) show the method of installation of the seismic damping wall according to the prior art.
Figure 8A:
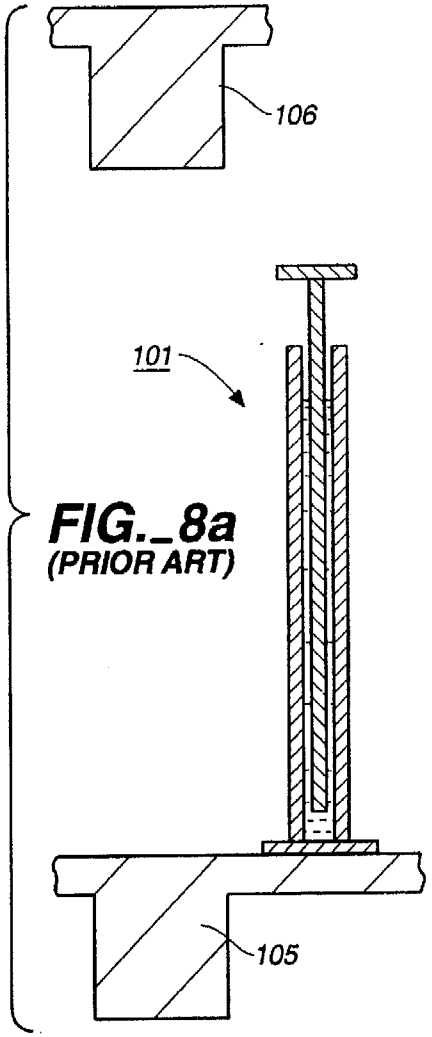
FIG. 8a (PRIOR ART)

As illustrated in FIGS. 5 and 6, the steel beam 10 along with the seismic damping wall 1 is lifted up with a crane and is attached to the building structure. The steel beam 10 is temporarily fixed as a part of the building structure. At this stage, the steel beam 11 on the lower floor is attached to the building structure. However, the hanging plate 2 and the standing plate 3 of the seismic device are temporarily combined with a clearance a designed to be smaller than the actual clearance needed to reach the structure. Therefore, there is a gap 14 at the bottom part of the seismic device, which is between the installation plate 5, on the standing plate 3, and the steel beam 11, on the lower floor. As a result, there is no trouble in the installation of the steel beam 10.

After the installation of the steel beam 10 to the upper floor, installation plate 5 on the standing plate 3 is temporarily fixed to the steel beam 11. At this point there should be a gap between the installation plate 5 and the steel beam 11, which requires a bolt that is longer than the gap.

Subsequently the steel beam 10 on the upper floor is adjusted to a more precise position and fixed with a bolt (the final fastening) and welded into position. After fixing to the upper floor, the hanging plate 2 and the standing plate 3 are separated. As illustrated in FIG. 6(*b*), the standing plate 3 is slowly lowered down and is fastened to the building by firmly fastening it with bolts 8. With this structure, the hanging plate 2 is fixed to the steel beam 10 on the upper floor and standing plate 3 is fixed to the steel beam 11 on the lower floor. The seismic damping wall now starts to function as a seismic device.

As explained above, the hanging plate and standing plate are temporarily combined, and installed into the building structure with the horizontal beam fixed to the structure. Therefore, it saves the time and trouble of carrying the device while composing the frame structure and transporting the device in a horizontal direction.

The seismic damping wall is temporarily set with a shorter distance than the distance between the actual horizontal beams in the building structure. Owing to this design, when the horizontal components are installed onto the upper floor of the building structure, the device does not reach the lower floor and saves trouble in determining the exact installation position of the seismic damper wall.

Furthermore, the standing plate can be installed precisely because the standing plate is slowly lowered down after separating the hanging plate and the standing plate.

In one embodiment of the invention, a viscous liquid is filled in between the hanging plate and standing plate before these plates are separated. Therefore, when the plates are released the standing plate lowers slowly under the resistance of the fluid, which enables the precise installation of the standing plate.

While the present invention has been particularly described with respect to the illustrated embodiment, it will be appreciated that various alterations, modifications and adaptations may be made based on the present disclosure, and are intended to be within the scope of the present invention. While the invention has been described in connection with what is presently considered to be the most practical and preferred embodiment(s), it is to be understood that the present invention is not limited to the disclosed embodiment(s) but, on the contrary, is intended to cover various modifications and equivalent arrangements included within the scope of the appended claims.

We claim:

1. A method of installing a seismic wall filled with damping fluid in a building structure, said method comprising:

mounting the seismic wall on a structural beam to be used in the building structure prior to filling the seismic wall with the damping fluid, thereafter, mounting the structural beam in the building structure, and thereafter, filling the seismic wall with the damping fluid.

2. The method of claim 1 wherein said step of mounting the seismic wall comprises mounting a seismic wall comprising first plates and a second plate the first plates being temporarily attached to the second plate while the seismic wall is mounted on the structural beam, the first plates defining a chamber and the second plate being positioned within the chamber, said method further comprising:

filling the chamber with a viscous fluid prior to detaching the first plates and the second plate from each other; and thereafter, detaching the first plates from the second plate.

3. A method of installing in a building a seismic wall of the type which has a first plate structure defining a chamber, a second plate structure positioned within said chamber, and a viscous fluid disposed within said chamber surrounding said second plate structure for absorbing energy when there is relative movement between said first and second plate structures, comprising the steps of:

(a) temporarily attaching the first and second plate structures to form an integral wall unit;

(b) thereafter, attaching said wall unit to a structural beam to be used in said building;

(c) thereafter, installing said structural beam in said building;

(d) thereafter, detaching said first and second plate structures so that they may move relative to each other.

4. The method of claim 3 wherein said chamber is filled with a viscous fluid between steps (c) and (d).

5. The method of claim 4 further comprising:

(e) thereafter, lowering the first plates.

6. The method of claim 5 further comprising:

(f) thereafter, attaching the first plates to a structural element on a lower floor.

* * * * *

UNITED STATES PATENT AND TRADEMARK OFFICE

CERTIFICATE OF CORRECTION

PATENT NO. : 5,740,652
DATED : April 21, 1998
INVENTOR(S) : Katsufumi Inoue, *et al.*

It is certified that error appears in the above-indentified patent and that said Letters Patent is hereby corrected as shown below:

Column 1, line 25, delete "1-673453" and insert therefor --1-97764--.

Column 4, line 20, delete "9mm" and insert therefor --19 mm--.

Signed and Sealed this

Tenth Day of November 1998

*Attest:*

Bruce Lehman

BRUCE LEHMAN

*Attesting Officer*

*Commissioner of Patents and Trademarks*